US007137531B2

(12) United States Patent
Arghyris et al.

(10) Patent No.: US 7,137,531 B2
(45) Date of Patent: Nov. 21, 2006

(54) DEVICE WITH RIGID CONTAINER AND MULTIPLE FLEXIBLE BAGS FOR PACKAGING AND DISPENSING FLUIDS

(75) Inventors: Laurent Arghyris, Boege (FR); Patrice Puviland, La Roche sur Foron (FR); Jean-Philippe Taberlet, Villard (FR)

(73) Assignee: Lablabo, Annemasse (FR)

( * ) Notice: Subject to any disclaimer, the term of this patent is extended or adjusted under 35 U.S.C. 154(b) by 85 days.

(21) Appl. No.: 10/498,560

(22) PCT Filed: Dec. 13, 2002

(86) PCT No.: PCT/FR02/04358

§ 371 (c)(1),
(2), (4) Date: Jun. 14, 2004

(87) PCT Pub. No.: WO03/053814

PCT Pub. Date: Jul. 3, 2003

(65) Prior Publication Data

US 2005/0029291 A1 Feb. 10, 2005

(30) Foreign Application Priority Data

Dec. 14, 2001 (FR) ..... 01 16246

(51) Int. Cl.
*B65D 35/22* (2006.01)
*B65D 35/30* (2006.01)
*B65D 35/56* (2006.01)

(52) U.S. Cl. ..... 222/94; 222/95; 222/105; 222/136; 222/145.5; 222/321.7

(58) Field of Classification Search ..... 222/94, 222/95, 105, 135, 136, 145.1, 145.5, 321.7, 222/321.9
See application file for complete search history.

(56) References Cited

U.S. PATENT DOCUMENTS

| | | | | |
|---|---|---|---|---|
| 3,672,544 | A * | 6/1972 | Marand | 222/94 |
| 5,411,176 | A | 5/1995 | Favre | |
| 6,082,588 | A * | 7/2000 | Markey et al. | 222/137 |
| 6,308,862 | B1 * | 10/2001 | Fillmore et al. | 222/94 |
| 6,736,288 | B1 * | 5/2004 | Green | 222/94 |
| 6,923,342 | B1 * | 8/2005 | Bourque et al. | 222/136 |
| 2002/0130138 | A1 * | 9/2002 | Crozet et al. | 222/94 |

FOREIGN PATENT DOCUMENTS

DE 9105565 U1 9/1991

OTHER PUBLICATIONS

Search Report issued in International Application No. PCT/FR02/04358, Apr. 24, 2003.

* cited by examiner

*Primary Examiner*—Joseph A. Kaufman
(74) *Attorney, Agent, or Firm*—Buchanan Ingersoll & Rooney PC

(57) ABSTRACT

The disclosure concerns packaging and dispensing of fluid products. The disclosed device comprises at least two sealed flexible bags arranged in a single common rigid container, associated with at least a pump or valve, actuated by an actuator, wherein the bags cooperate with at least a ring for being fixed to the container and with the pumps or valves. The device is designed to dispense fluids separately or mixed.

37 Claims, 4 Drawing Sheets

DEVICE WITH RIGID CONTAINER AND MULTIPLE FLEXIBLE BAGS FOR PACKAGING AND DISPENSING FLUIDS

CROSS-REFERENCE TO RELATED APPLICATIONS

This application is a §371 application of International Patent Application No. PCT/FR02/04358, filed Dec. 13, 2002, and published in French on Jul. 3, 2003, as International Publication No. WO 03/053814, which claims priority to French Patent Application No. 01/16246, filed Dec. 14, 2001. The disclosures of these applications are incorporated herein in their entirety.

BACKGROUND OF THE INVENTION

1. Field of the Invention

The present invention relates to a device for packaging and dispensing fluid products, and more particularly a novel device for packaging and dispensing fluid, liquid or pasty products, of the type comprising at least two flexible bags placed in a single rigid container and connected to one or more pumps or valves, for the storage, protected from the air, of at least two fluid products and for dispensing them, as a mixture or separately, in an efficient manner.

2. Description of the Related Art

Devices of the pocket flask type for packaging and dispensing fluids are well known. They generally comprise a container with a rigid shell in which is placed a flexible bag that contracts as the product is extracted from it. The product may be expelled from the bag using an airless pump or under the pressure of a propellant gas acting within the flask, on the wall of the bag. When the product is expelled from the bag using an airless pump, a vent is provided, generally in the base or neck of the flask, to allow external air to enter the space between the flask and the bag each time the pump is actuated, thus allowing the bag to contract while maintaining sufficient pressure on its walls. An example of an embodiment using this method is described in patent FR 2 723 356 relating to a device comprising a flexible bag made of plastic, such as polyethylene or polypropylene, in a rigid container whose neck has an air inlet.

Another device using this method and designed for the selective dispensing of one or two products, separately or as a mixture, is described in patent FR 2 804 666, according to which a first product is introduced into the bag whereas the second, together with the propellant gas, are in the rigid container, around the bag, the whole being supplemented with a selective valve. However, this system is relatively complex and requires a special valve.

U.S. Pat. No. 5,411,176 describes a rigid container containing two flexible bags, in which the container is provided with a circular flange under which are fastened two bags inserted through the flask's removable base, and bearing two airless pumps. Another device comprising a rigid container associated with two bags and two valves is described in utility model DE-91 05 565 in which the bags are fastened via tubular sleeves and connecting tubes to a plate housing the valves.

The problems with this method are often linked to the deformations in the wall of the bag as it contracts, which can hold back considerable amounts of product and limit the efficiency with which the fluid is dispensed. Another problem is to ensure satisfactory sealing of the bag so as to preserve the integrity of the product contained therein. Specifically, the products contained in the bags are often sensitive to oxidation caused by oxygen in the air and can deteriorate if air enters the bag. Sealing defects are often found at the junction between the bag and the pump. They can also result from a degree of porosity of the materials used to make the bag. Lastly, the folds formed by the wall of the bag as it contracts can lead to tears that can let air in which degrades the product contained in the bag.

These problems are exacerbated when it is desired to use two or more bags within the same rigid container to dispense, simultaneously or separately, two or more complementary products.

SUMMARY OF THE INVENTION

The subject of the present invention is precisely a device for packaging and dispensing fluid, liquid or pasty products, of the type comprising at least two sealed flexible bags placed in the same single rigid container, connected to one or more pumps or valves, for efficient dispensing of at least two products separately or as a mixture.

The subject of the invention is also a device for packaging and dispensing several fluid products each contained in a separate bag, making the bags very easy to fill without the need for complex or specially designed equipment.

The subject of the invention is also a device for packaging and dispensing several fluid products, of the type comprising at least two sealed flexible bags placed in the same single rigid container, ensuring perfect packaging of the product by means of excellent sealing of the bag.

Finally, the subject of the invention is a device of the type stated above, which can be manufactured profitably.

The device for packaging and dispensing fluid products according to the present invention is of the type comprising at least two sealed flexible bags placed in the same single rigid container, connected to at least one pump or valve, and it is distinguished by the fact that each bag comprises means cooperating with at least one ring for fastening to the rigid container and with the pump(s) or valve(s).

According to one advantageous embodiment, each bag comprises at least one flat surface for assembly with another bag, the bags being contiguous via their respective flat surfaces.

According to a preferred embodiment, the device of the invention comprises at least two bags combined with a single ring for fastening to the container and to the pumps or valves, the ring being fastened to the bags by any known fastening means such as welding, adhesive bonding, snap-fastening or mechanical crimping. The single ring used in the invention is advantageously designed to allow fastening of the bags by snapping their neck over the ring, making the elements of the device very easy to manufacture and assemble.

Likewise, the pump, or the valve, may be fastened to the bag by the same fastening means, preferably by snap-fastening.

According to another preferred embodiment, the two bags are formed as a single piece and thus are in the form of a double bag comprising two compartments separated by a partition, each compartment preferably comprising its own opening having a neck for the fastening of a pump. This embodiment has the advantage that it stiffens the structure of the bag by means of the separating partition, which simplifies the replacement of the products contained in the bags.

According to a variant, the bags and the ring are formed as a single unitary piece, produced by extrusion, blow molding, extrusion-blow molding or injection-blow molding using a suitable plastic.

The pumps used in the invention are airless pumps, as commonly used in the art.

The plastics used to produce the bags may be chosen for example from among a polyethylene, a polypropylene, a polyamide, an ethylene/vinyl alcohol (EVOH) copolymer, etc. They may consist of single-layer materials or multilayer complexes including a metal layer, for example a layer of aluminum forming a barrier that reinforces sealing, combined with one or more layers of plastic. The bag may be produced using these materials by methods such as injection-blow molding or extrusion-blow molding in a suitable mold. The bag may also be produced by welding a plastic or metal film or a multilayer metal/plastic complex on a support forming the neck of the bag.

The material used for the ring may be a plastic of the same nature as that used for the bag, but treated so as to make it sufficiently rigid, for example by using a greater thickness of material. Thus, polyethylene or polypropylene rings may be used and, as stated above, the ring and the bags may be produced as a single piece, by injection-blow molding or any other suitable method. The rigid container may be produced from plastic or any other suitable rigid material. For example, rigid containers may be made from polyethylene, polyethylene terephthalate (PET), glass or metal, such as aluminum.

As stated above, the device comprises a single ring associated with several bags, the whole being placed in a rigid container.

The openings made in the ring are preferably arranged symmetrically about the center of the ring, but they may also be nonsymmetrical depending on the shape of the cylinder and the desired effects.

The cylinder formed by the bag is not a body of revolution, its section not being circular, but is preferably a straight cylinder with a semicircular section comprising at least one flat lateral surface serving as the junction between the bags in the same container. Other shapes may easily be made, for example a substantially elliptical shape, or any continuous or polygonal shape, or alternatively a noncylindrical shape, depending on the esthetic effect desired or made necessary by the shape of the rigid container.

Depending on the case, each pump fitted to each bag may be actuated by an independent push-button or, alternatively, a single push-button may be provided for simultaneously actuating two or more pumps.

According to the invention, two or more identical bags may be associated, but it is also possible to combine bags of different volumes, the metering chamber of each pump then being preferably adapted to the volume of the corresponding bag. This is particularly advantageous in the case of the dispensing of complementary fluid products that must be mixed in predetermined quantities. Thus, a device with a rigid container and two flexible bags according to the invention may be adapted to the ratio of mixing of the two products contained in the bags, and if this ratio must be 2/1 for example, the volume of the second bag can be made to be half that of the first, and likewise for the volume of the metering chamber of the second pump with respect to the first. Thus, each time the single push-button is pressed, two volumes of the first product will be expelled for just one of the second, and the two bags will empty in parallel.

In order for the bags to be able to contract inside the rigid container, an external air intake is provided in the form of a vent or an air suction circuit. In its simplest form, the vent is provided in the wall, for example in the base of the rigid container, and it is preferably equipped with a valve and/or a filter. The air circuit, allowing external air to enter the volume between the wall of the rigid container and the bags, is preferably designed to remain closed while the fluid is stored in each bag and to open only each time the pumps are actuated so as to allow only a volume of air equivalent to the volume of fluid expelled from each bag to enter. When the pumps cease to be actuated, the air circuit is automatically closed, thus ensuring optimum preservation of the products contained in the bags by limiting evaporation through the wall of the bags.

According to a preferred embodiment, the air circuit consists of a passage made in the rim of the ring, communicating with the space between the pump and the push-button, and comprising means for closing it off when the pump is not actuated. Thus, in the rest position, the air circuit can be closed off by the seal created between the piston and its fastening ring.

The fluid products contained in the bags may be expelled separately, when the device comprises separate push-buttons, or simultaneously. Simultaneous and controlled expulsion of the fluid products is advantageous in the case of products that have to be mixed at the time of use and in predetermined proportions. Having a single push-button acting on two or more pumps facilitates this simultaneous expulsion, and the choice of pumps having suitable metering chambers ensures the composition of the mixture in the right proportions. Thus, the metering chambers of the pumps may be proportional to the volume of the bags. Furthermore, the device of the invention may comprise juxtaposed or concentric product outlet nozzles, to ensure thorough mixing of the products from each bag. According to a variant, the pump outlet ducts may be joined to emerge in a common outlet nozzle, mixing then taking place in the nozzle.

The pocket container according to the present invention has the advantage of being easy to fill without it being necessary to use complex equipment. According to the present invention, it can be filled using standard equipment, simply under gravity, thus ensuring very regular filling. Furthermore, the few restrictions on the shape of the bag means it can be easily adapted to rigid containers of various shapes.

Various wording and illustrations may be affixed to the bag or to the rigid container, for example by printing or screen-printing, depending on the envisioned use.

As it is used and the products contained in it are extracted, each bag contracts steadily, limiting the risks of splitting or tearing.

The rate of release of the product, i.e. the ratio between the volume of product introduced into the bag during filling and the volume extracted during use, is excellent, and may be greater than 90%.

The device for packaging and dispensing fluid products according to the invention is especially suitable for products with complementary action or activity that must not be mixed until they are used and must be stored separately to prevent them from reacting with one another. One application in which the invention may thus advantageously be used is, for example, two-component adhesives, where one component accelerates the curing of the other.

Another application is cosmetic or dermatological compositions, such as creams and gels, in which it may be expedient to mix at the time of use two components which have to be stored separately to prevent them from reacting with one another.

A number of nonlimiting embodiments of suitable bags and flasks forming devices for packaging and dispensing various fluids, according to the present invention, are described in more detail below, with reference to the appended drawings.

DETAILED DESCRIPTION OF THE PREFERRED EMBODIMENTS

Figure 1:
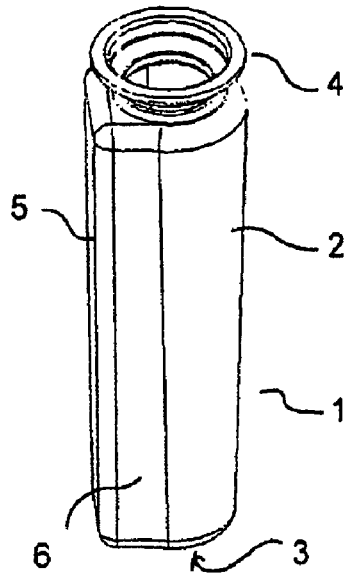
FIG. 1: a perspective view of a bag according to the present invention made by injection-blow molding a thermoplastic.

The bag (1) shown in FIG. 1 comprises a semicircular wall (2) closed off by a base (3) and open at the top at a neck (4). This bag is made of polypropylene and is produced by injection-blow molding. The body (2) of the bag is flexible while the neck (4), which is thicker, is rigid.

As shown in FIG. 1, the body of the bag is not symmetrical about its axis but comprises a flat face (5) joined to the semi-cylindrical part by a side wall (6) on each side. The exact dimensions of the flat part (5) and of the two side walls (6), and the angle at which they meet are determined according to the assembly of the bags and their placing in the rigid container.

Figure 2:
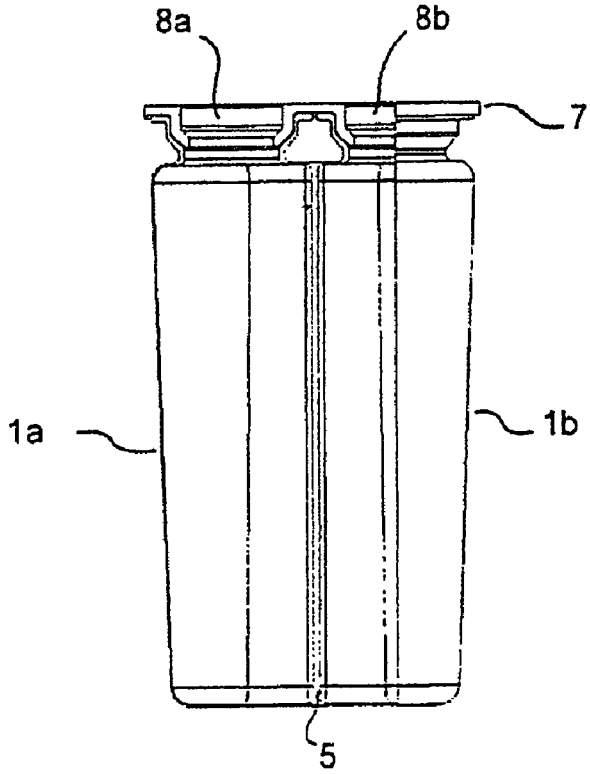
FIG. 2: a view in partial section and in perspective of the assembly of two bags according to FIG. 1, held in place by a ring.

Two bags (1*a*, 1*b*), identical to that of FIG. 1, are assembled to the same ring (7) comprising two openings (8*a*, 8*b*) communicating with the necks (4) of the bags, as shown in FIG. 2. The two bags (1*a*) and (1*b*) are assembled via their flat face (5). These two bags may be produced as a single component constituting a bag with two compartments separated by the face (5) serving as a partition. The neck (4*a*) of the bag (1*a*) may be fastened to the opening (8*a*) by snap-fastening or welding.

Figure 3:
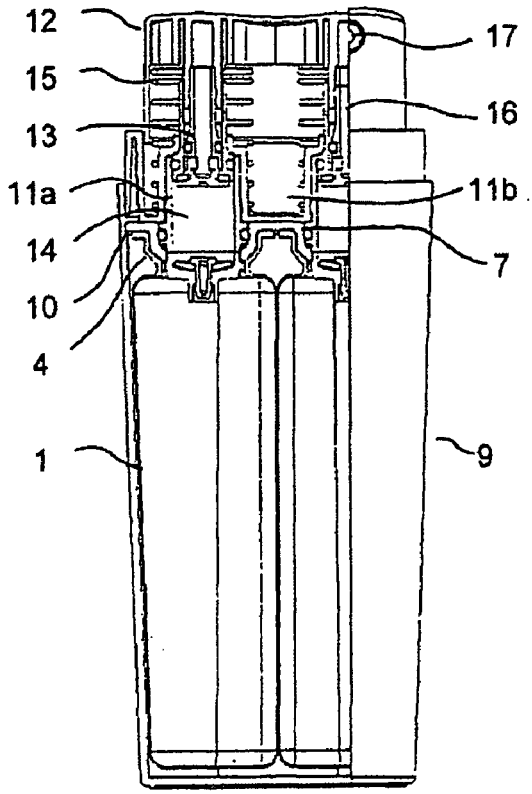
FIG. 3: a view in partial section and in perspective of an assembly comprising the bags of FIG. 2 and their respective pumps, held in place by a ring, and placed in a rigid container having a single push-button.

Once the two bags have been attached to the ring (7), the assembly is placed in the rigid container (9) shown in FIG. 3, made of polypropylene by injection-blow molding. The ring (7) is fastened in the rigid container (9) by forced snap-fastening of the rim of the ring cooperating with a groove (10) made in the internal wall of the rigid container (9).

As shown in FIG. 3, a pump (11*a*, 11*b*) is placed in each opening (8) of the ring. The pumps (11*a*, 11*b*) are mounted in a sealed manner on the neck (4) of the bag (1) and are actuated by a single push-button (12). Sealing may be ensured in the usual manner, for example by means of an O-ring seal. Pressing on the push-button (12) causes the hollow piston (13) to move in the chamber (14) of each pump. Releasing the push-button causes the piston (13) to rise back up under the action of the spring (15) and the metering chamber (14) to fill. Actuating the piston again dispenses a metered quantity through the duct (16) and the nozzle (17), causing the bag (1) to contract. A vent (not shown) made in the flask allows external air to enter the volume between the rigid container (9) and the bags (1), allowing the bags to contract as the push-button (12) is actuated. The pump may operate conventionally via valves (not shown) that are placed at the inlet and outlet of the metering chamber (14).

Figure 5:
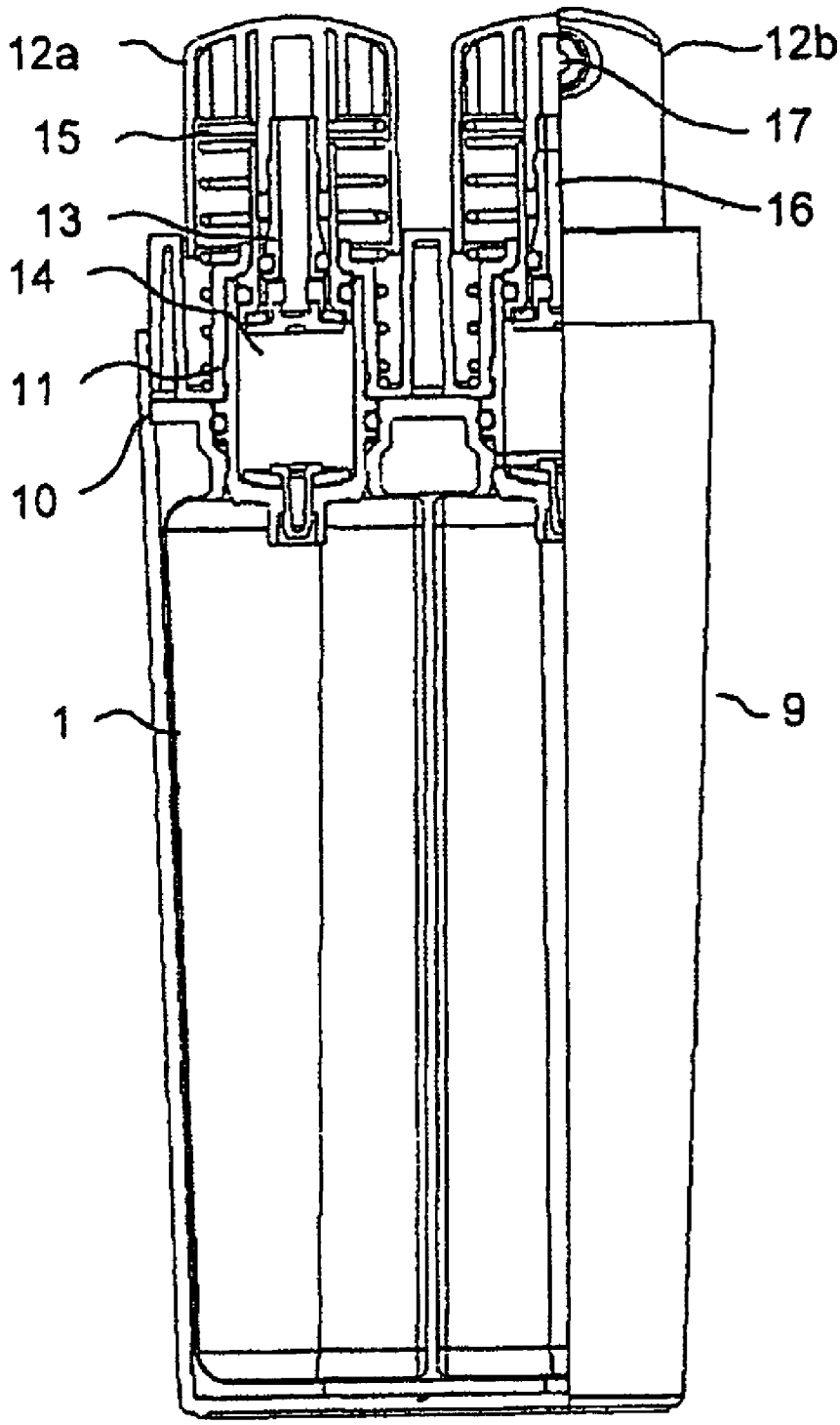
FIG. 5: a view in partial section and in perspective of an assembly comprising the bags of FIG. 4 and their respective pumps, placed in a rigid container having a push-button for each pump.

As shown in FIG. 5, the single push-button (12) may be replaced by two push-buttons (12*a*, 12*b*) each actuating the two pumps (11*a*, 11*b*), respectively.

Figure 4:
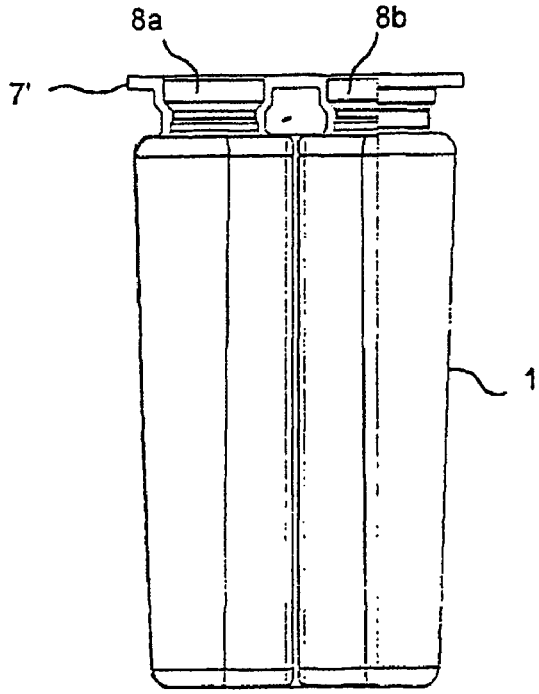
FIG. 4: a view in partial section and in perspective of a variant of the bag of FIG. 2 comprising a single integrated ring.

In the variant of FIG. 4, the two bags (1) and the ring (7') are produced by molding as a single piece.

Figure 6:
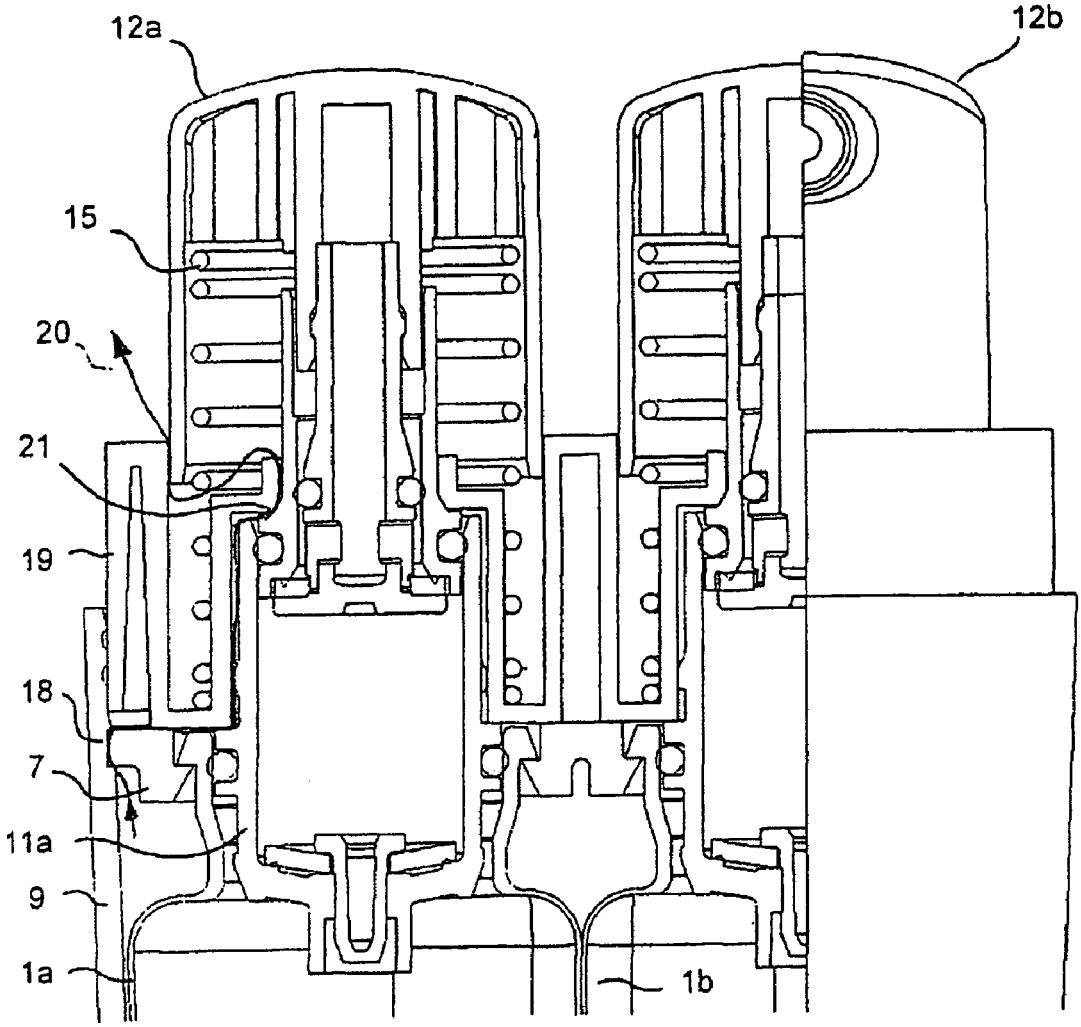
FIG. 6: a view of a variant of the device shown in FIG. 3.

FIG. 6 shows a partial view of the device of FIG. 5, showing the air inlet circuit for placing the volume between the internal wall of the rigid container (9) and the bags (1*a*, 1*b*) in communication with the outside when the pumps (11*a*, 11*b*) are actuated by pressing on one or other of the push-buttons (12*a*, 12*b*).

The passage for air is provided by grooves (18) made in the side edge of the rim of the ring (7) which place the volume between the rigid container (9) and the bags (1) in communication with the space separating the body of the pump (11) from the ring (19) for fastening the push-button (12), and hence with the outside, following the arrow (20).

This air passage is open when the push-button (12) is actuated and closed when it is pushed back up under the action of the spring (15). Thus, in the rest position, the air circuit is closed off by the seal created between the piston (13) and its fastening ring (21).

The invention claimed is:

1. A device for packaging and dispensing several fluid products, comprising at least two sealed flexible bags placed in the same single rigid container, connected to at least one pump or valve, wherein each bag comprises means cooperating with at least one ring for fastening to the container and with the pump(s) or valve(s), and further comprising an air circuit between the outside and the volume between a wall of the rigid container and the bags, wherein the air circuit comprises a passage made in a rim of the ring, communicating with a space between the pump and a push-button, and comprising means for closing when the pump is not actuated.

2. The device as claimed in claim 1, wherein each bag comprises at least one flat surface for assembly with another bag.

3. The device as claimed in claim 2, comprising at least two bags combined with a single ring for fastening to the container and to the pump(s) or valve(s).

4. The device as claimed in claim 2, which comprises two bags formed as a single piece, in the form of a double bag comprising two compartments separated by a partition.

5. The device as claimed in claim 2, wherein the bags and the ring are formed as a single unitary piece, produced by molding using a suitable plastic.

6. The device as claimed in claim 2, wherein the bags are produced by injection-blow molding or extrusion-blow molding a material chosen from the group consisting of a polyethylene, a polypropylene, a polyamide, and an ethylene/vinyl alcohol (EVOH) copolymer.

7. The device as claimed in claim 2, wherein the bags are produced by welding a plastic or metal film or a multilayer metal/plastic complex on a support forming the neck of the bag.

8. The device as claimed in claim 1, wherein the bags have different volumes.

9. The device as claimed in claim 1, wherein at least two bags combined with a single ring for fastening to the container and to the pump(s) or valve(s).

10. The device as claimed in claim 9, wherein the bags are fastened by snapping their neck over the ring.

11. The device as claimed in claim 10, wherein the bags are produced by injection-blow molding or extrusion-blow molding a material chosen from the group consisting of a polyethylene, a polypropylene, a polyamide, and an ethylene/vinyl alcohol (EVOH) copolymer.

12. The device as claimed in claim 10, wherein the bags are produced by welding a plastic or metal film or a multilayer metal/plastic complex on a support forming the neck of the bag.

13. The device as claimed in claim 9, which comprises two bags formed as a single piece, in the form of a double bag comprising two compartments separated by a partition.

14. The device as claimed in claim 9, wherein the bags and the ring are formed as a single unitary piece, produced by molding using a suitable plastic.

15. The device as claimed in claim 9, wherein the bags are produced by injection-blow molding or extrusion-blow molding a material chosen from the group consisting of a polyethylene, a polypropylene, a polyamide, and ethylene/vinyl alcohol (EVOH) copolymer.

16. The device as claimed in claim 9, wherein the bags are produced by welding a plastic or metal film or a multilayer metal/plastic complex on a support forming the neck of the bag.

17. The device as claimed in claim 9, wherein the bags have different volumes.

18. The device as claimed in claim 1, which comprises two bags formed as a single piece, in the form of a double bag comprising two compartments separated by a partition.

19. The device as claimed in claim 18, wherein the bags are fastened by snapping their neck over the ring.

20. The device as claimed in claim 18, wherein the bags and the ring are formed as a single unitary piece, produced by molding using a suitable plastic.

21. The device as claimed in claim 18, wherein the bags are produced by injection-blow molding or extrusion-blow molding a material chosen from the group consisting of a polyethylene, a polypropylene, a polyamide, and an ethylene/vinyl alcohol (EVOR) copolymer.

22. The device as claimed in claim 18, wherein the bags are produced by welding a plastic or metal film or a multilayer metal/plastic complex on a support forming the neck of the bag.

23. The device as claimed in claim 18, wherein the bags have different volumes.

24. The device as claimed in claim 1, wherein the bags and the ring are formed as a single unitary piece, produced by molding using a suitable plastic.

25. The device as claimed in claim 24, wherein the bags are produced by injection-blow molding or extrusion-blow molding a material chosen from the group consisting of a polyethylene, a polypropylene, a polyamide, and an ethylene/vinyl alcohol (EVOH) copolymer.

26. The device as claimed in claim 24, wherein the bags are produced by welding a plastic or metal film or a multilayer metal/plastic complex on a support forming the neck of the bag.

27. The device as claimed in claim 24, wherein the bags have different volumes.

28. The device as claimed in claim 1, wherein the bags are produced by injection-blow molding or extrusion-blow molding a material chosen from the group consisting of a polyethylene, a polypropylene, a polyamide, and an ethylene/vinyl alcohol (EVOH) copolymer.

29. The device as claimed in claim 1, wherein the bags are produced by welding a plastic or metal film or a multilayer metal/plastic complex on a support forming the neck of the bag.

30. The device as claimed in claim 1, wherein each pump fitted to each bag is actuated by an independent push-button.

31. The device as claimed in claim 1, which further comprises a single push-button simultaneously actuating two or more pumps.

32. The device as claimed in claim 31, which further comprises juxtaposed or concentric product outlet nozzles, to ensure the mixing of the products from each bag.

33. The device as claimed in claim 31, wherein the pump outlet ducts are joined to emerge in a common outlet nozzle where the mixing takes place.

34. The device as claimed in claim 1, wherein the bags have a substantially elliptical, polygonal or noncylindrical shape.

35. The device as claimed in claim 34, wherein the bags have different volumes.

36. The device as claimed in claim 1, wherein the bags have different volumes.

37. The device as claimed in claim 36, wherein the volume of a metering chamber of each pump is proportional to the volume of the bag.

* * * * *

UNITED STATES PATENT AND TRADEMARK OFFICE

CERTIFICATE OF CORRECTION

PATENT NO. : 7,137,531 B2
APPLICATION NO. : 10/498560
DATED : November 21, 2006
INVENTOR(S) : Laurent Arghyris et al.

It is certified that error appears in the above-identified patent and that said Letters Patent is hereby corrected as shown below:

Col. 6, Line 66
Please correct Claim 8 as follows:

8. The device as claimed in claim [[1]] 2, wherein the bags are produced by welding a plastic or metal film or a multilayer metal/plastic complex on a support forming the neck of the bag.

Signed and Sealed this

Seventh Day of August, 2007

JON W. DUDAS
*Director of the United States Patent and Trademark Office*